US008203501B2

(12) United States Patent
Kim

(10) Patent No.: US 8,203,501 B2
(45) Date of Patent: Jun. 19, 2012

(54) ANTENNA DEVICE FOR MOBILE COMMUNICATION SYSTEM

(75) Inventor: Duk-Yong Kim, Gyeonggi-do (KR)

(73) Assignee: KMW Inc. (KR)

( * ) Notice: Subject to any disclaimer, the term of this patent is extended or adjusted under 35 U.S.C. 154(b) by 418 days.

(21) Appl. No.: 12/507,400

(22) Filed: Jul. 22, 2009

(65) Prior Publication Data

US 2010/0231469 A1 Sep. 16, 2010

(30) Foreign Application Priority Data

Mar. 10, 2009 (KR) ..... 20-2009-0002724 U

(51) Int. Cl.
*H01Q 1/12* (2006.01)

(52) U.S. Cl. ..... 343/890; 343/872; 343/873

(58) Field of Classification Search ..... 343/890, 343/872, 873, 878
See application file for complete search history.

(56) References Cited

U.S. PATENT DOCUMENTS

| | | | | |
|---|---|---|---|---|
| 5,963,178 | A * | 10/1999 | Jones | 343/890 |
| 6,912,408 | B1 * | 6/2005 | O'Neill et al. | 455/561 |
| 2004/0141321 | A1 * | 7/2004 | Dowling et al. | 362/276 |
| 2009/0040750 | A1 * | 2/2009 | Myer | 362/183 |

FOREIGN PATENT DOCUMENTS

| | | | |
|---|---|---|---|
| JP | 2002230655 | A | 8/2002 |
| KR | 100611806 | B1 | 8/2006 |
| KR | 100638514 | B1 | 10/2006 |
| KR | 100713202 | B1 | 5/2007 |

* cited by examiner

*Primary Examiner* — Dieu H Duong

(57) ABSTRACT

An antenna device for a mobile communication system is provided, in which a post has a selected external appearance. An antenna end is formed at an upper portion of the post for installing antenna parts, and a support end is formed at a lower portion of the post for fixing the antenna device to the ground. At least part of an external body of the antenna end is formed of a material that transmits transmission and received radio signals and a ground support member is formed under the support end to make an external body of the support end stand erect on the ground. The external appearance of the antenna device may take the form of a conventional utility, lamp, or sign post or pole.

17 Claims, 3 Drawing Sheets

ANTENNA DEVICE FOR MOBILE COMMUNICATION SYSTEM

CLAIM OF PRIORITY

This application claims the benefit under 35 U.S.C. §119 (a) of a Korean Utility Model Application filed in the Korean Intellectual Property Office filed on Mar. 10, 2009 and assigned Serial No. 20-2009-0002724, the entire disclosure of which is hereby incorporated by reference.

BACKGROUND OF THE INVENTION

1. Field of the Invention

The present invention generally relates to a mobile communication system. More particularly, the present invention relates to an antenna device for a Base Station (BS) in a mobile communication system.

2. Description of the Related Art

In a mobile communication system, a BS (including a Relay Station (RS)) typically collects data from Mobile Stations (MSs) via their connections and transmits the collected data to a switching network. The BS amplifies a transmission signal through a high-power amplifier within a BS body, transmits the amplified signal to an antenna device, and radiates it through the antenna device. The antenna device receives a signal from an MS and transmits the received signal to the BS body, for processing. For the purpose of providing a service, the antenna device is installed at a high place such as a building rooftop or a tower and the base station is installed on the ground within a building or under a tower.

As stated above, the antenna device is installed in an elevated position to maximize the propagation distance of a radio signal. In an urban area, typically, a post is put up on the rooftop of a building, a fixture is mounted onto the post, and a communication antenna is installed to the fixture.

Although the antenna device for the mobile communication system should be installed at an appropriate position to enable reliable wireless communications, such a site is hard to secure because the antenna device is considered as an obstacle to a living environment and thus building owners typically do not want antenna equipment installed. Therefore, it is difficult to find an installation site for the antenna device.

Especially in an urban area where people make mobile calls frequently, high cost is another obstacle to the siting of the antenna device.

In the meantime, street lamps for illuminating roads and surveillance cameras for night watch are installed to their separate posts downtown. Antenna devices, street lamps, surveillance cameras, etc. are installed on separate posts although they commonly require a post for installation, power supply, and a communication function. Accordingly, there are too many unnecessary and disfiguring posts in downtown or urban environments.

SUMMARY OF THE INVENTION

An aspect of exemplary embodiments of the present invention is to address at least the problems and/or disadvantages and to provide at least the advantages described below. Accordingly, an aspect of exemplary embodiments of the present invention is to provide an antenna device for a mobile communication system, which can be installed in a place where an existing street lamp or a surveillance camera is installed in order to facilitate securing of an installation site.

Another aspect of exemplary embodiments of the present invention provides an antenna device for a mobile communication system to facilitate securing a commercial power supply and ready connection to a communication cable.

A further aspect of exemplary embodiments of the present invention provides an antenna device for a mobile communication system to reduce the number of posts used for module installation by enabling installation of a lamp module for a street lamp, a surveillance camera module, and various sensor modules to one post.

Still another aspect of exemplary embodiments of the present invention provides an antenna device for a mobile communication BS, which looks good or at least looks familiar in order to be harmonized with the ambient environment.

In accordance with an aspect of exemplary embodiments of the present invention, there is provided an antenna device for a mobile communication system, in which a post or pole having the external appearance of a conventional sign, lamp, or utility pole has an antenna end for housing and receiving antenna parts, and a support end for fixing the post or pole to the ground. The antenna end may be at the upper end and the support end at the lower end of the post or pole.

An external enclosure of the antenna device may further include a lighting module for illuminating a surrounding area and a camera module for capturing the surrounding area.

BRIEF DESCRIPTION OF THE DRAWINGS

The above and other objects, features and advantages of certain exemplary embodiments of the present invention will be more apparent from the following detailed description taken in conjunction with the accompanying drawings, in which.

Throughout the drawings, the same drawing reference numerals will be understood to refer to the same or similar elements, features and structures.

DETAILED DESCRIPTION OF EXEMPLARY EMBODIMENTS

The matters defined in the description such as a detailed construction and elements are provided to assist in a comprehensive understanding of exemplary embodiments of the invention. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

Figure 1:
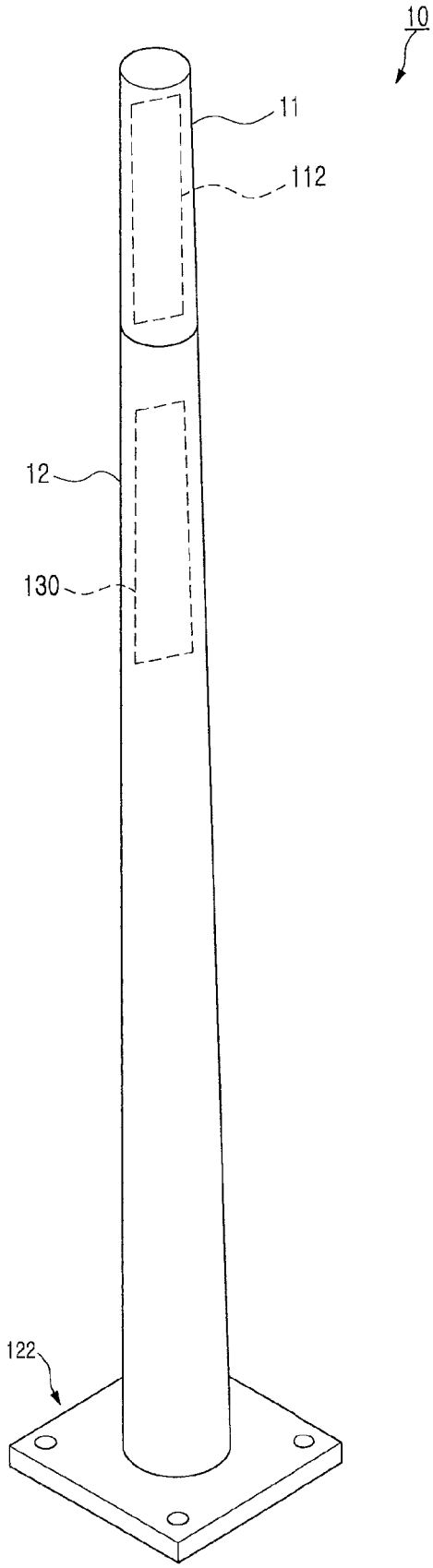
FIG. 1 is an exterior perspective view of a mobile communication antenna device according to an exemplary embodiment of the present invention.

FIG. 1 is an exterior perspective view of a mobile communication antenna device according to an exemplary embodiment of the present invention.

Referring to FIG. 1, a mobile communication base station (BS) antenna device 10 according to an exemplary embodiment of the present invention takes the external overall form of a conventional lamp, utility, or sign post or pole. In the illustrated case of FIG. 1, the post-shaped BS antenna device 10 may include an antenna end 11 at an upper portion of the post, for installation and housing of antenna parts or components including a reflective plate 112 of an antenna and a support end 12 at a lower portion of the post, for fixing the post-shaped antenna device 10 onto the ground.

At least part of the external body of the antenna end 11 may be formed of a material that does not hinder transmission and reception of a radio signal to and from a radiator. For example, the part of the external body of the antenna device 10 may be formed of the same material as that of a radome of a conventional antenna device, that is, a plastic such as Fiber Reinforced Plastic (FRP), Acrylonitrile Styrene Acrylate (ASA), Poly Vinyl Chloride (PVC), etc.

The external body of the support end 12 is formed of a metal or Fiberglass Reinforced Plastic (FRP). To allow the support end 12 to stand erect on the ground, a ground support member 122 is formed under the support end 12. The ground support member 122 may be configured so as to have one or more holes formed at an appropriate position, for receiving a concrete-based anchor bolt (not shown) on the ground. The post-shaped support end 12 having the ground support member 122 may look like a utility pole or a street lamp pole. A control module 130 may be provided within the external body of the support end 12, for providing overall control to the operations of the antenna device 10. As described in greater detail with reference to FIGS. 1 and 2, control module 130 may also include a number of sensor modules, including cameras and the like.

While the antenna end 11 and the support end 12 may be separately fabricated and then combined in the BS antenna device 10, together they have the overall appearance of a single post.

As described above, the BS antenna device 10 of the present invention may have a post appearing as a street lamp pole and a mobile communication antenna built therein.

Meanwhile, a base station may be installed separately as is done conventionally and connected to the antenna device 10. Or the base station may be contained in the BS antenna device 10, for example, in the support end 11 according to another exemplary embodiment of the present invention. Notably, the base station may be installed at an upper portion within the post-shaped support end 12, to guard against damage caused by breakage and submersion.

The installation of the base station within the post-shaped antenna device 10 narrows the distance between the conventional antenna device and the base station, thereby reducing signal loss.

Figure 2:
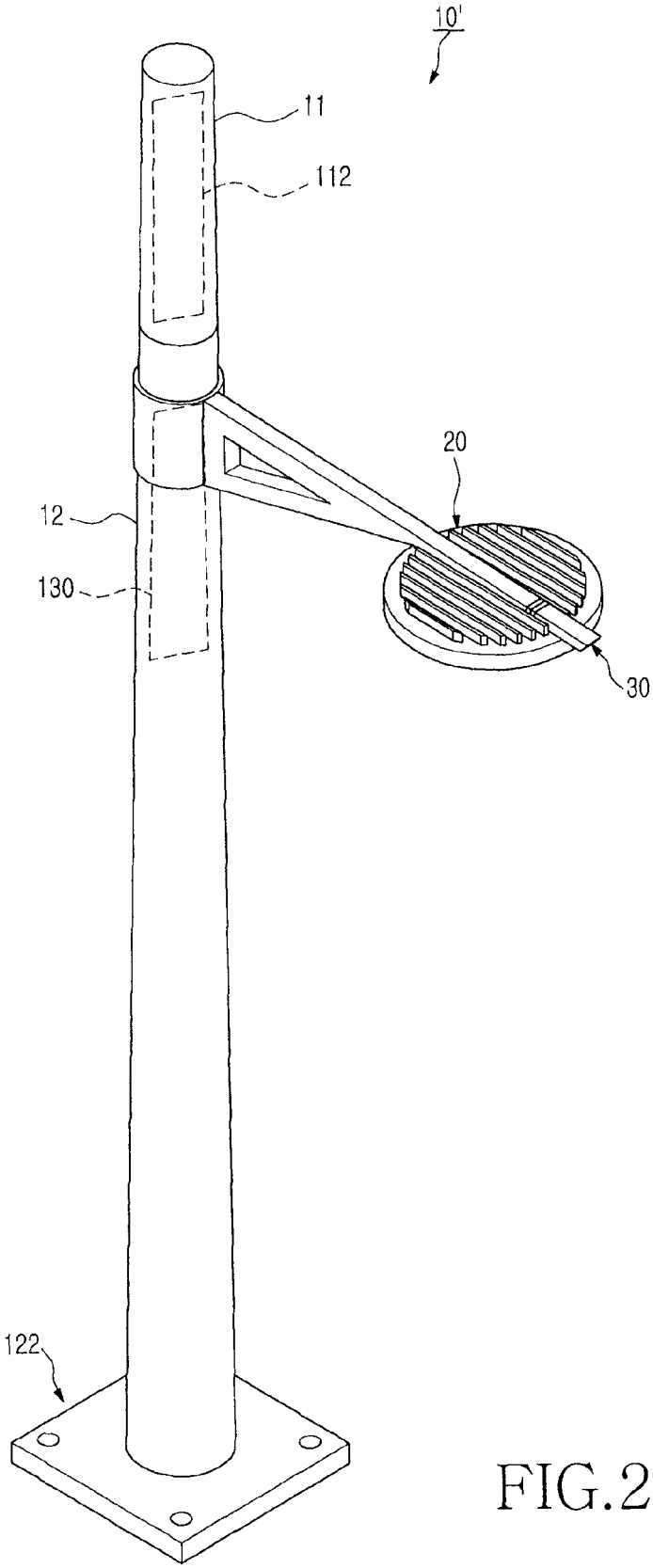
FIG. 2 is an exterior perspective view of a mobile communication antenna device according to another exemplary embodiment of the present invention.
Figure 3:
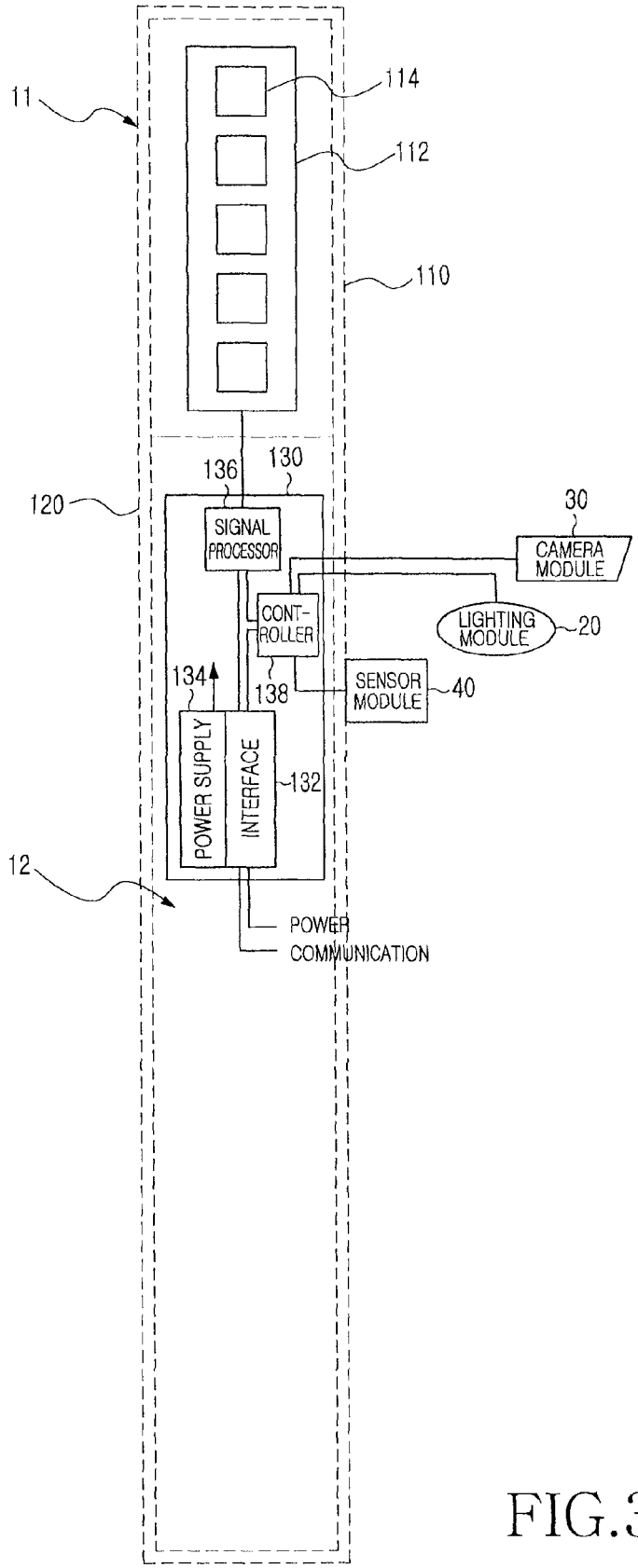
FIG. 3 is a block diagram of the mobile communication antenna device illustrated in FIG. 2.

FIG. 2 is an exterior perspective view of a mobile communication antenna device according to another exemplary embodiment of the present invention, and FIG. 3 is a block diagram of the mobile communication antenna device illustrated in FIG. 2.

Referring to FIGS. 2 and 3, a mobile communication antenna device 10' according to another exemplary embodiment of the present invention takes the overall appearance of a conventional sign, lamp, or other post, as in the exemplary embodiment of the present invention illustrated in FIG. 1. Also, the post-shaped BS antenna device 10' may include the antenna end 11 at an upper portion of the post for installing antenna parts, and the support end 12 at a lower portion of the post for fixing the post-shaped antenna device 10' onto the ground.

As in the exemplary embodiment of the present invention illustrated in FIG. 1, at least part of an external body 110 of the antenna end 11 is formed of a material that does not hinder transmission and reception of a radio signal to and from a radiator 114. For example, the part of the external body 110 (FIG. 3) of the antenna device 10' may be formed of the same material as that of a radome of a conventional antenna device, that is, a plastic such as FRP, ASA, PVC, etc.

The external body 120 (FIG. 3) of the support end 12 is formed of a metal or FRP and the ground support member 122 is formed under the support end 12 to allow the support end 12 to stand erect on the ground, as in the exemplary embodiment of the present invention illustrated in FIG. 1. The ground support member 122 may be configured so as to have one or more holes formed at an appropriate position, for receiving a concrete-based anchor bolt (not shown) formed on the ground. The post-shaped support end 12 having the ground support member 122 may look like a conventional utility pole or a street lamp pole.

Compared to the exemplary embodiment of the present invention illustrated in FIG. 1, a lighting module 20 is added to the external body of the antenna device 10', for example, to an upper portion of the support end 12, below antenna end 11. The lighting module 20 may include a high-pressure mercury lamp, a fluorescent lamp, a sodium lamp, or a Light Emitting Diode (LED) for illumination, which is usually used as a light source for a street lamp device, and illuminates the area around the mobile communication antenna device 10'.

When the lighting module 20 is installed in the antenna device 10', it may look like a familiar street lamp. Thus, the antenna device 10' may feel familiar in harmony with the ambient environment.

Further, because the antenna device 10' is configured so as to be installed on the ground, the installation task may be easier when it is installed on a flat land in the suburbs or countryside, and thereby facilitate securing an installation site by replacing an existing street lamp. As a consequence, power is readily secured and connection to a communication cable is made easier.

Meanwhile, the control module 130 of antenna device 10' further includes a camera module at an appropriate position, for capturing an image of the area in which the antenna device 10' is installed, as illustrated in FIG. 3. Thus, the antenna device 10' is additionally equipped with a surveillance function.

Also, sensor modules including a motion sensor, a weather sensor, and an illumination or luminance sensor may be added to the post of the antenna device 10', to provide those surveillance or informational functions.

As described above, the mobile communication antenna device 10' has an illumination function and a surveillance function in addition to the conventional functions of a mobile communication antenna device, as it includes the lighting module 20, the camera module 130, and a sensor module 40. This configuration and operation of the antenna device 10' will be described below in greater detail with reference to FIG. 3.

Referring to FIG. 3, the control module 130 is provided in the external body of the antenna device 10' (FIG. 2), for example, in the external body 120 of the support end 12, for providing overall control to the operations of the antenna device 10'. The control module 130 includes an interface 132 for communicating with a remote base station and receiving external commercial power. The control module 130 also includes a power supply 134 for distributing the power received through the interface 132 for the operation of the camera module 30 and the lighting module 20 and for the operation of the antenna device 10' inside. The control module 130 further includes a signal processor 136 for processing signals transmitted and received between the interface 132 and antenna elements 114 and a controller 138 for providing overall control to the antenna device 10' including the camera module 30 and the lighting module 20.

The control module 130 includes the sensor module 40 with sensors for rendering the operational control of the camera module 30 and the lighting module 20 under the controller 138 more accurate. For example, the sensor module 40 may include an illumination or luminance sensor or a motion sensor. Therefore, the controller 138 can control illumination and/or brightness of the lighting module 20 based on brightness information received through the illumination sensor and can control the lighting module 20 to be less bright based on information received through the motion sensor, when there is no moving object like a person or a vehicle. Also, the controller 138 may enable image capture by the camera module 30, for example only when a moving object is sensed through the motion sensor.

To be more specific about the camera module 30, data captured by a surveillance camera is usually transmitted to a separately constituted local server via a dedicated line. The local server temporarily stores captured data received from a plurality of surveillance cameras, individually, and transmits the captured data to a central server over a communication network such as a dedicated network or the Internet. The central server preserves and manages the captured data.

According to the present invention, data captured by the camera module 30 may be transmitted to a Base Station Controller (BSC) via a communication line basically established between a BS and the BSC, without passing through a separately procured dedicated line. The BSC may preserve and manage the captured data or transmit the captured data to a central server designed for preservation and management of the captured data over a communication network, such as a dedicated network or the Internet. Data captured by each camera module 30 has an Identifier (ID) of a camera that has captured the data, so that the captured data may be stored on a camera basis.

The central server stores the captured data of each camera received from the BS through the BSC, and searches for and displays the captured data of a specific camera according to a manipulation of an operator. The operator or a subscriber that is pre-registered to receive a service may remotely access the central server through a terminal (not shown) and receive the captured data search and display service from the central server.

As is apparent from the above description, the antenna device for a mobile communication system according to the present invention is shaped into a post on the whole and includes a support end to be fixed on the ground and an antenna installation end for installing antenna parts. Therefore, because a light for a street lamp or a surveillance camera can be installed on the post, the antenna device may substitute for a conventional street lamp and surveillance camera. As a result, an installation site for the antenna device may be more readily secured.

Also, there is no need to secure a new site for installing a wireless BS and the difficulty in finding a site, which is expensive in an urban area with a large number of mobile calls, is avoided.

The replacement of a conventional street lamp and surveillance camera with the antenna device facilitates securing power and connection to an existing communication cable.

Because the post of the antenna device is shaped like a familiar street lamp or utility pole, the antenna device may feel familiar and in harmony with the ambient environment.

The mobile communication antenna devices according to the exemplary embodiments of the present invention may be configured and operated as described above. While the above description has been made of specific exemplary embodiments, many modifications can be made within the scope of the present invention. For example, while the external enclosure of the antenna end 11 and the support end 12 has a cylinder-like shape, it is clear that it may take the shape of a rectangular prism or an octagonal prism.

Also, the sensor module may include various sensors, such as a temperature-humidity sensor, in addition to the illumination or luminance sensor or the mobility object sensor and the antenna device may transmit information sensed by these sensors, for use in a variety of services.

The antenna device may transmit data captured by the camera module or other sensor modules in real time. Or the antenna device may include an inner memory, temporarily store the captured data in the inner memory, and transmit the captured data every appropriate period (or at an appropriate timing).

The antenna device may transmit the data captured by the camera module or other sensor modules in the same manner as a mobile communication signal is usually transmitted, by using the camera module as a terminal of a mobile communication network. That is, a phone number is pre-assigned to the camera module, for identification, and a phone number is also pre-assigned to the central server, so that a video communication channel may be established between the camera module and the central server over a communication network. Herein, the central server may be provided in a BS or a BSC in a typical mobile communication system. In this case, the data captured by the camera module may be transmitted in the early morning in which a smaller number of calls are conducted over the mobile communication network.

While the invention has been shown and described with reference to certain exemplary embodiments of the present invention thereof, it will be understood by those skilled in the art that various changes in form and details may be made therein without departing from the spirit and scope of the present invention as defined by the appended claims and their equivalents.

What is claimed is:

1. An antenna device for a mobile communication system, comprising:

a post having an external body with a selected external appearance;

an antenna end formed at an upper portion of the post, the antenna end formed of a material that transmits and receives radio signals and configured for installation and housing of antenna parts;

a support end formed at a lower portion of the post, the support end configured for fixing the antenna device onto the ground;

a lighting module carried by the post for illuminating a surrounding area;

a camera module carried within the post for capturing images of the surrounding area; and a control module for providing overall control to operations of the antenna device, the control module including:

an interface configured to communicate with an external entity and to receive external commercial power;

a power supply configured to distribute the power received through the interface as operation power for the antenna device including operation power for the camera module and the lighting module;

a signal processor configured to process signals transmitted and received between the interface and antenna elements; and a controller configured to provide overall control to operations of the antenna device including operations of the camera module and the lighting module.

2. The antenna device of claim 1, further comprising a sensor module within the post, the sensor module including a motion sensor for sensing movement in the surrounding area, a weather sensor for sensing weather, and an illumination sensor for sensing illumination.

3. The antenna device of claim 2, wherein illumination of the lighting module and an operation of the camera module are controlled based on illumination information and moving object information received from the illumination sensor and motion sensor of the sensor module.

4. The antenna device of claim 1, wherein a base station is contained within the external body of the antenna device.

5. The antenna device of claim 1, wherein the selected external appearance is that of a street lamp post.

6. An antenna device for a mobile communication system, comprising:

a post having an external body with a selected external appearance;

an antenna end formed at an upper portion of the post, the antenna end formed of a material that transmits and receives radio signals and configured for installation and housing of antenna components;

a support end formed at a lower portion of the post, the support end configured for fixing the antenna device onto the ground;

a sensor module housed within the external body, the sensor module including one or more of a camera, an illumination sensor, a weather sensor, and a motion sensor; and a control module for providing overall control to operations of the antenna device, the control module including:

an interface configured to communicate with an external entity and to receive external commercial power;

a power supply configured to distribute the power received through the interface as operation power for the antenna device including operation power for the sensor module;

a signal processor configured to process signals transmitted and received between the interface and antenna elements; and a controller configured to provide overall control to operations of the antenna device including operations of the sensor module.

7. The antenna device of claim 6, further comprising a lighting module carried by the post for illuminating a surrounding area.

8. The antenna device of claim 7, wherein illumination of the lighting module and operation of the camera are controlled based on illumination information and moving object information received from the illumination sensor and motion sensor of the sensor module.

9. The antenna device of claim 6, wherein a base station is contained within the external body of the antenna device.

10. The antenna device of claim 6, wherein the selected external appearance is that of a street lamp post.

11. An antenna device for a mobile communication system, comprising:

a post having an external body with a selected external appearance;

an antenna end formed at an upper portion of the post, the antenna end formed of a material that transmits and receives radio signals and configured for installation and housing of antenna parts;

a support end formed at a lower portion of the post, the support end configured for fixing the antenna device onto the ground; and a control module for providing overall control to operations of the antenna device, the control module including:

an interface configured to communicate with an external entity and to receive external commercial power;

a power supply configured to distribute the power received through the interface as operation power for the antenna device;

a signal processor configured to process signals transmitted and received between the interface and antenna elements; and a controller configured to provide overall control to operations of the antenna device.

12. The antenna device of claim 11, further comprising a lighting module carried by the post for illuminating a surrounding area.

13. The antenna device of claim 12, further comprising a camera module carried within the post for capturing images of the surrounding area.

14. The antenna device of claim 13, further comprising a sensor module within the post, the sensor module including a motion sensor for sensing movement in the surrounding area, a weather sensor for sensing weather, and an illumination sensor for sensing illumination.

15. The antenna device of claim 14, wherein illumination of the lighting module and an operation of the camera module are controlled based on illumination information and moving object information received from the illumination sensor and motion sensor of the sensor module.

16. The antenna device of claim 11, wherein a base station is contained within the external body of the antenna device.

17. The antenna device of claim 11, wherein the selected external appearance is that of a street lamp post.

* * * * *